US007953356B2

(12) United States Patent
Ito

(10) Patent No.: US 7,953,356 B2
(45) Date of Patent: May 31, 2011

(54) IMAGE FORMING APPARATUS

(75) Inventor: Michiaki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 227 days.

(21) Appl. No.: 11/819,588

(22) Filed: Jun. 28, 2007

(65) Prior Publication Data

US 2008/0003018 A1 Jan. 3, 2008

(30) Foreign Application Priority Data

Jun. 30, 2006 (JP) ..... 2006-181733

(51) Int. Cl.
*G03G 15/01* (2006.01)

(52) U.S. Cl. ..... 399/303; 399/165; 399/308

(58) Field of Classification Search ..... 399/162, 399/165, 302, 303, 308, 313
See application file for complete search history.

(56) References Cited

U.S. PATENT DOCUMENTS

| | | | | |
|---|---|---|---|---|
| 5,530,532 | A * | 6/1996 | Iino et al. | 399/237 |
| 6,160,978 | A * | 12/2000 | Tsuruoka et al. | 399/165 |
| 2004/0114951 | A1 * | 6/2004 | Kawagoe | 399/66 |

FOREIGN PATENT DOCUMENTS

| | | | |
|---|---|---|---|
| JP | 07-164383 | A | 6/1995 |
| JP | 08-025283 | A | 1/1996 |
| JP | 09-015990 | A | 1/1997 |
| JP | 2000-132001 | A | 5/2000 |
| JP | 2000-155480 | A | 6/2000 |
| JP | 2000-275976 | A | 10/2000 |
| JP | 2000-337464 | A | 12/2000 |
| JP | 2002-355789 | A | 12/2002 |
| JP | 2002-372823 | A | 12/2002 |
| JP | 2005-025052 | A | 1/2005 |
| JP | 2006-142489 | A | 6/2006 |
| JP | 2008-003459 | A | 1/2008 |

* cited by examiner

*Primary Examiner* — David P Porta
*Assistant Examiner* — Benjamin Schmitt
(74) *Attorney, Agent, or Firm* — Kubotera & Associates LLC

(57) ABSTRACT

An image forming apparatus includes a first roller; a second roller; a belt tensely provided between the first roller and the second roller; and a guiding member for guiding an edge of the belt. Further, the belt has an edge surface having a step portion of equal to or smaller than 0.05 mm and a ten-point mean roughness (Rz) of equal to or smaller than 5.0 μm.

9 Claims, 8 Drawing Sheets

IMAGE FORMING APPARATUS

BACKGROUND OF THE INVENTION

1. Field of the Invention

The present invention relates to an image forming apparatus.

2. Description of Related Art

A conventional electro-photographic image forming apparatus such as a printer, a copier, a fax machine, and a multi-function machine thereof forms an image through the following process. In a case of, for example, the printer, a surface of a photosensitive drum or an image supporting member is charged with a charging roller. Then, an LED head exposes the surface of the photosensitive drum to form a latent image. A developing roller electrostatically attaches a thin layer of toner to the latent image to form a toner image; and a transfer roller transfers the toner image to a sheet, thereby forming an image or printing. After transferring the toner image, a cleaning blade cleans toner remaining on the photosensitive drum. Afterward, the sheet with the toner image transferred thereon is sent to a fixing device, thereby fixing the toner image to the sheet.

In a color printer, four image forming units are arranged for forming a toner image in each color. The photosensitive drum is arranged in each of the image forming units, and a transferring device is arranged facing each of the image forming units. The transferring device has a driving roller; an idle roller; an endless belt tensely provided between the driving roller and the idle roller; and a transfer roller provided facing the photosensitive drum with the endless belt inbetween.

In the transferring device, the endless belt moves to transport a sheet, and a toner image in each color is transferred onto the sheet by overlaying the toner images with the transfer roller, thereby forming a color toner image. Then, the color toner image is fixed to the sheet, thereby forming a color image.

In the color printer described above, the endless belt may be provided with a reinforcing tape along an edge thereof in order to prevent a crack from forming in the edge while the endless belt is running (refer to Patent Reference). Patent Reference Japan Patent Publication No. 11-219046

In the conventional image forming device, it is troublesome to put the reinforcing tape on the endless belt. The reinforcing tape tends to twine around each roller and deform each time the endless belt passes the driving roller and the idle roller. When the reinforcing tape repeatedly twines and deforms, the reinforcing tape comes off from the endless belt. Once the reinforcing tape comes off, the endless belt directly receives a stress due to repetitive deformation, so that the endless belt is damaged from the edge thereof and cracked, and even broken later. As a result, durability of the endless belt is impaired.

In view of the problems described above, an object of the invention is to provide an image forming apparatus having a belt with improved durability.

Further objects and advantages of the invention will be apparent from the following description of the invention.

SUMMARY OF THE INVENTION

In order to attain the objects described above, according to the present invention, an image forming apparatus includes a first roller; a second roller; a belt tensely provided between the first roller and the second roller; and a guiding member for guiding an edge of the belt. Further, the belt has an edge surface having a step portion of equal to or smaller than 0.05 mm and a ten-point mean roughness (Rz) of equal to or smaller than 5.0 μm.

In the present invention, the belt has the edge surface having the step portion of less than 0.05 mm and the ten-point mean roughness (Rz) of equal to or smaller than 5.0 μm. Accordingly, when the belt moves, it is possible to prevent a crack form forming in an edge of the belt, thereby improving durability of the belt.

DESCRIPTION OF THE PREFERRED EMBODIMENTS

Hereunder, embodiments of the present invention will be explained with reference to the accompanying drawings. In the description below, a color printer is described as an example of an image forming apparatus.

First Embodiment

Figure 2:
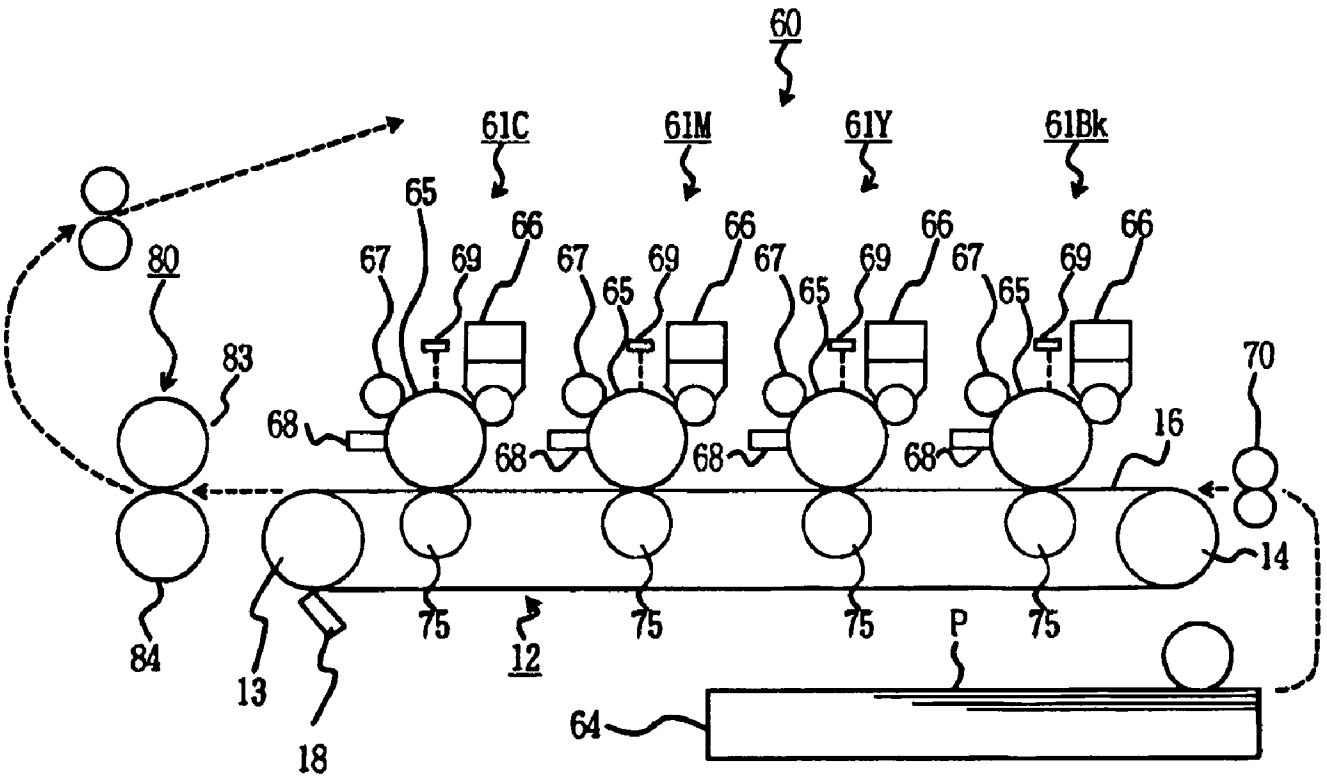
FIG. 2 is a schematic view showing a printer according to the first embodiment of the present invention.

FIG. 2 is a schematic view showing a printer 60 according to the first embodiment of the present invention. As shown in FIG. 2, the printer 60 has image forming units 61Bk, 61Y, 61M, and 61C for forming a toner image as a developer image in each color, i.e. black, yellow, magenta, and cyan; a transfer device 12 arranged facing the image forming units 61Bk, 61Y, 61M, and 61C for forming a transfer region in each color with respect to the image forming units 61Bk, 61Y, 61M, and 61C, and for transferring a toner image in each color to a sheet or a record medium; a sheet cassette 64 as a print medium supplying unit for feeding a sheet P to each transfer region; a register roller 70 for supplying the sheet P from the sheet cassette 64 at a proper timing when an image is formed at the image forming units 61Bk, 61Y, 61M and 61C; and a fuser 80 as a fixing device for fixing a color toner image to the sheet P after transferring the image in each transfer region. The fuser 80 has a heating roller 83 as a first rotational member and a pressuring roller 84 as a second rotational member.

In the embodiment, the sheet P may include, in addition to a normal sheet commonly used for copying, an OHP sheet, a card, a postcard, a cardboard heavier than about 100 g/m$^2$, an envelope, and so on. Furthermore, a sheet having a large heat capacity, so-called a special sheet, can be also used.

In the embodiment, the image forming units 61Bk, 61Y, 61M, and 61C have a same structure. Each of the image forming units 61Bk, 61Y, 61M, and 61C comprises a photosensitive drum 65 or an image supporting member disposed freely rotatable. Further, each of the image forming units 61Bk, 61Y, 61M, and 61C comprises a charging roller (charging device) 67; a developing device 66; and a cleaning blade (i.e. cleaning device) 68 arranged in this order along a direction of rotation of the photosensitive drum 65. A LED head 69 as an irradiating device is disposed between the charging device 67 and the developing device 66 for irradiating a surface of the photosensitive drum 65.

The transfer device 12 is connected to a motor (not illustrated), which a driving unit for image transfer, and comprises a driving roller 13 or a first roller rotated by the motor; an idle roller 14 or a second roller rotating as the driving roller 13 rotates; an endless belt 16 as a transfer belt tensely provided between the driving roller 13 and the idle roller 14; a transfer roller 75 or a transfer member disposed inside the endless belt 16 and rotatably provided facing each photosensitive drum 65; and a cleaning blade 18 or a cleaning member disposed contacting an outer surface of the endless belt 16.

An operation of the printer 60 having the above-described structure will be described below. First, when a power switch (not illustrated in the figure) of the printer 60 is turned on and an operator starts an image formation operation, i.e. printing, using a specific operating unit, each of the photosensitive drums 65 rotates and is charged by the charging roller 67 while rotating.

Then, a surface of the photosensitive drum 65 is exposed to light irradiated by the LED head 69, and an electrostatic latent image is formed on the surface according to image data. The developing device 66 attaches toner as developer to the photosensitive drum 65, so that the electrostatic latent image is developed to form a toner image.

Thereafter, as the endless belt 16 runs, toner images of black, yellow, magenta, and cyan are respectively transferred to the sheet P in this order, and a color toner image is formed. The sheet P is sent to the fuser 80, where the color toner image on the sheet P is heated with pressure and fixed. The sheet P, on which toner is fixed, is discharged outside the printer main body. After transferring the toner image onto the sheet, toner remaining on the photosensitive drum 65 is scraped off and removed by the cleaning blade 18.

In the embodiment, toner is formed of a styrene-acrylic co-polymer containing 9 wt. % of paraffin wax in toner particles through emulsion polymerization. Further, toner has an average particle size of 7 μm and sphericity of 0.95. With this type of toner, the image transfer efficiency can be improved, and it is not necessary to use a mold-releasing agent in the fuser 80. In addition, the dot reproducibility can be improved, and an image can be developed with superior resolution. Also, a shaper image and a high quality image can be achieved.

In the embodiment, the cleaning blade 18 is formed of a urethane rubber having a thickness of 1.5 mm and a rubber hardness of 83° measured according to JIS-A. The cleaning blade 18 is disposed so as to apply a line pressure of about 4.3 g/mm. When the cleaning blade 18 is formed of an elastic material such as a urethane rubber, it is possible to effectively eliminate toner and foreign matters remaining on the endless belt 16. Further, it is possible to simplify a structure with a compact size and reduce a cost thereof. The cleaning blade 18 is formed of a urethane rubber due to high hardness, has elasticity, large mechanical strength, wear resistance, oil resistance, and ozone resistance.

Figure 1:
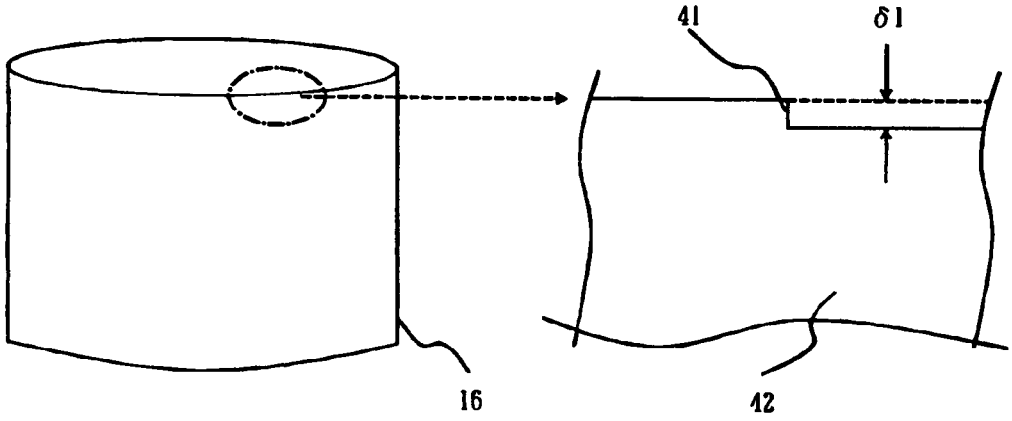
FIG. 1 is a schematic view showing an endless belt member according to a first embodiment of the present invention.

A method of manufacturing the endless belt 16 will be described next. FIG. 1 is a schematic view showing an endless belt member 34 according to the first embodiment of the present invention.

Figure 3:
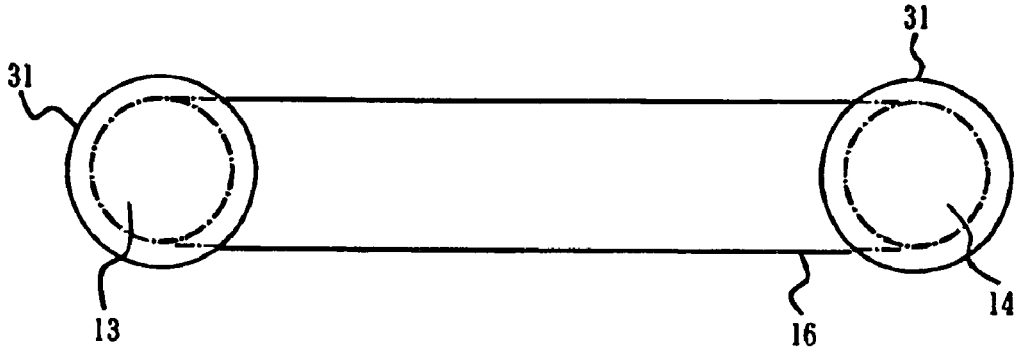
FIG. 3 is a schematic front view showing a transferring device according to the first embodiment of the present invention.
Figure 4:
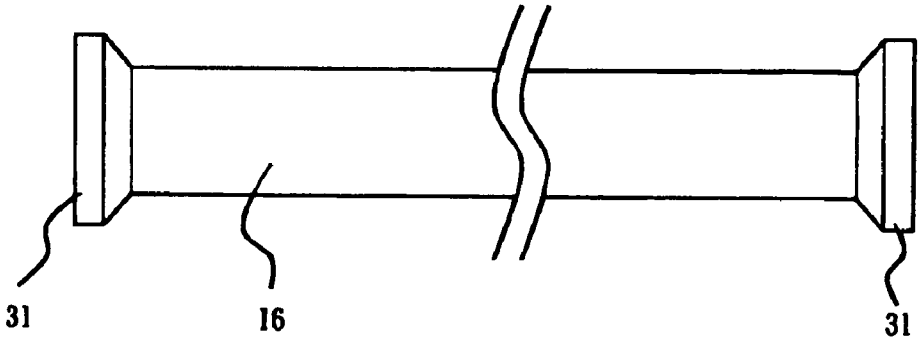
FIG. 4 is a schematic side view showing the transferring device according to the first embodiment of the present invention.
Figure 5:
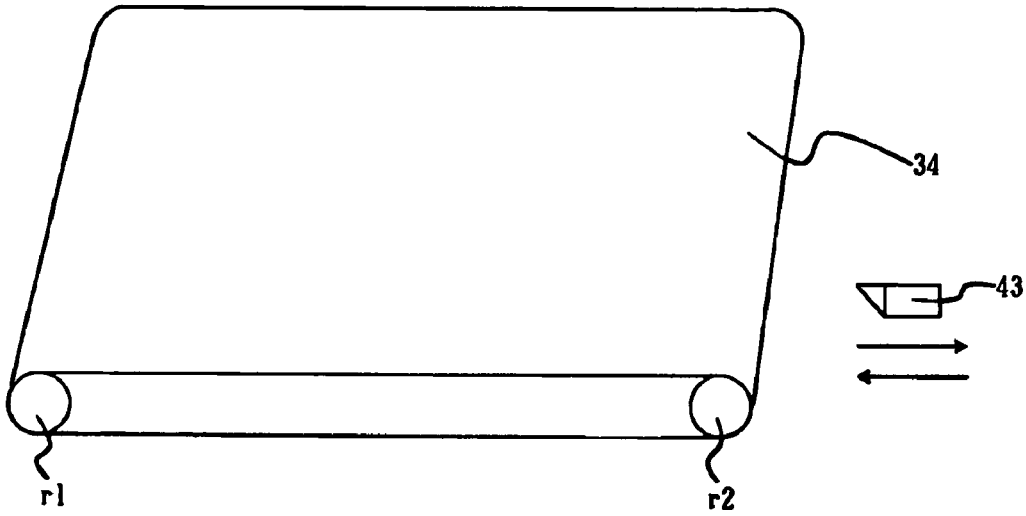
FIG. 5 is a schematic perspective view showing a method of cutting the endless belt member according to the first embodiment of the present invention.
Figure 6:
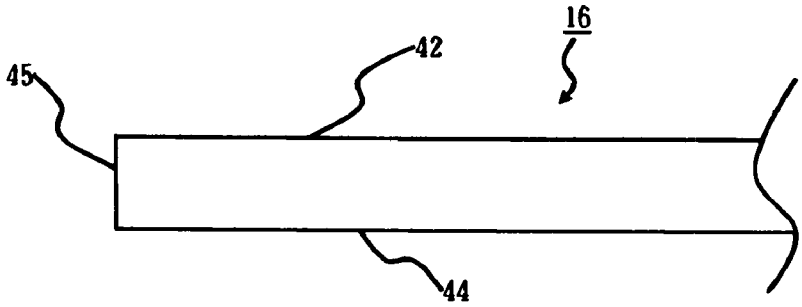
FIG. 6 is a schematic cross-sectional view of an endless belt according to the first embodiment of the present invention.

FIG. 3 is a schematic front view showing the transferring device 12 according to the first embodiment of the present invention. FIG. 4 is a schematic side view showing the endless belt 16 according to the first embodiment of the present invention. FIG. 5 is a schematic perspective view showing a method of cutting the endless belt member 34 according to the first embodiment of the present invention. FIG. 6 is a schematic cross-sectional view of the endless belt 16 according to the first embodiment of the present invention.

As shown in FIGS. 3 and 4, the endless belt 16 is tensely provided between the driving roller 13 and the idle roller 14, and runs as the driving roller 13 rotates. At both ends of the driving roller 13 and the idle roller 14, flanges 31 are provided as a guiding member having an outer diameter larger than those of the driving roller 13 and the idle roller 14 in order to prevent the endless belt 16 from winding or unevenly moving as the endless belt 16 runs.

In the embodiment, the flanges 31 are attached to both ends of the driving roller 13 and the idle roller 14, and are designed to rotate with the driving roller 13 and the idle roller 14. Alternatively, the flanges 31 may be arranged in a main body of the printer 60 to face the both ends of the driving roller 13 and the idle roller 14. Also, the guiding member can be attached to another roller, or disposed so as to contact with an edge of the endless belt 16 and be away from the driving roller 13 and the idle roller 14.

The endless belt 16 is explained in more detail next. The endless belt 16 is formed of a material such as a polyamide-imide. After an appropriate amount of carbon black is added in the polyamide-imide to provide electro-conductivity, a mixture is stirred in an N-methylpyrrolidone solution. Then, as shown in FIG. 5, the endless belt member 34 is formed through rotational molding to have a thickness of 100 μm and an opening diameter of 198 mm. After forming the endless belt member 34, the endless belt member 34 is cut with a cutter 43 or a cutting member having two knife blades into a 230 mm wide piece, thereby forming the endless belt 16 as shown in FIG. 6.

In the embodiment, as shown in FIG. 5, the cutter 43 approaches from an outer circumferential surface 42 of the endless belt member 34. Then, the cutter 43 cuts the endless belt member 34 into the endless belt 16 having a specified width while the endless belt member 34 rotates for one cycle in a state that the endless belt member 34 is tensely disposed between support rollers r1 and r2. As shown in FIG. 6, the endless belt 16 has the outer circumferential surface 42; an inner circumferential surface 44; and an edge surface 45 contacting with the flange 36 disposed at the edges of the endless belt 16.

In the embodiment, instead of the support rollers r1 and r2, one cylindrical body may be provided for forming the endless belt 16. In this case, the cylindrical body has a tapered portion fitting to the inner circumferential surface 44 of the endless belt member 34. The cylindrical body is inserted from one edge of the endless belt member 34.

Further, it is possible to use a small cylindrical member having a degree of freedom larger than that of the inner circumferential surface 44 of the endless belt member 34. In this case, the small cylindrical member can be divided into several divided members, and then each divided member is widened toward the inner circumferential surface 44 using an air cylinder. The cutter 43 may be formed of ceramics instead of steel, and may have a cutter blade having an angle in a single stage or a double stage. Instead of the cutting 43 of contact-type, a cutting member of non-contact type such as laser may be used.

In the embodiment, the endless belt 16 may be formed of a material not limited to the above-described polyamide-imide. The endless belt 16 is preferably formed of a material having sufficient durability and mechanical properties, so that the endless belt 16 deforms under tensile within a specific range when the endless belt 16 is running. Further, it is preferred to use a material capable of withstanding wearing, breaking, and cracking of the edges of the endless belt 16 due to repetitive sliding motion against the flanges 31.

For example, the endless belt 16 may be formed of a resin such as polyimide (PI), polycarbonate (PC), polyamide (PA), polyetheretherketone (PEEK), polyvinylidene difluoride (PVdF), an ethylene-tetrafluoroethylene copolymer, and a mixture thereof having a Young's modulus of at least 2,000 MPa, preferably at least 3,000 MPa, similar to the above-described polyamide-imide.

When the endless belt member 34 is molded through the rotational molding, the solvent is optionally selected according to the material of the endless belt member 34, and an organic solvent such as N,N-dimethylacetamides is normally used. For example, N,N-dimethylformamide, N,N-dimethylacetamide, dimethyl sulfoxide, N-methylpyrrolidone, pyridine, tetramethylene sulfone, dimethyl tetramethylene sulfone and so on can be used solely or as a mixture thereof. When the endless belt member 34 is molded through extrusion molding, it is possible to mold without a solvent.

In the embodiment, the carbon black may include, for example, furnace black, channel black, ketjen black, acetylene black, and so on. The carbon blacks can be used alone or as a mixture thereof. The type of carbon black is suitably selected based on the electro-conductivity, and channel black and furnace black are preferably used. Depending on the use, the carbon black may be oxidized or treated to prevent oxidation degradation such as by grafting, or may be treated so as to improve dispersion in the solvent.

In the embodiment, an amount of carbon black is determined according to the type of carbon black. In the case of the endless belt 16 of the printer 60, at least 3 wt. % and not larger than 40 wt. %, preferably at least 3 wt. % and equal to or less than 30 wt. %, of carbon black is used with respect to a solid content of a resin in view of mechanical strength and other properties. When the content of carbon black is more than 40 wt. %, the endless belt 16 tends to be easily cracked (broken), and when the content of carbon black is less than 3 wt. %, the electroconductivity of the endless belt 16 becomes lower.

When the endless belt member 34 is cut to form the endless belt 16, a cutting portion may move in a shaft direction, and a thicker section 41 may be formed as shown in FIG. 1. When the thicker section 41 or a step portion δl becomes larger than other portion of the belt, the edge of the endless belt 16 may be cracked when the endless belt 16 runs.

Accordingly, the durability of the endless belt 16 was evaluated according to the step portion δl and surface roughness of the edge surface 45 of the endless belt 16. The surface roughness was measured through a ten-point mean roughness Rz according to JIS B0601-1994. In order to calculate the ten-point roughness Rz, a stylus of a measuring device contacted with the edge surface 45 of the endless belt 16, and a displacement of the stylus was measured when the endless belt 16 moved lengthwise, so that a roughness profile was determined. The surface profile was determined for a standard length along a mean line of the surface profile. With the mean line as standard, the ten-point mean roughness Rz was calculated as a sum of an average of absolute values of five highest peaks and an average of absolute values of five deepest valleys.

In order to evaluate the durability of the endless belt 16, a PPC sheet was used as the sheet P, and the test was performed under a temperature of 23° C. and humidity of 50%.

In the evaluation, as a printing pattern, five band-shaped images in black having a width of 3 mm and a pitch of about 50 mm were printed onto the sheet P with the A4 size (297 mm long×210 mm wide) in a longitudinal direction thereof. Accordingly, a page coverage rate was calculated as follows:

$$3\ \text{mm} \times 5\ \text{bands}/297\ \text{mm} \times 100 \approx 5\%$$

Further, in the evaluation, at the page coverage density of 5%, 3 P/J printing (7 seconds intermission after printing three sheets of the A4 size sheet in the longitudinal direction) was performed for 34,000 cycles as a target. It is known that when the endless belt 16 runs 34,000 cycles or more, a fluctuation in an electric resistance becomes large, thereby deteriorating performance of the endless belt 16 due to the electrical fluctuation. Accordingly, it is sufficient that the endless belt 16 runs up to 34,000 cycles for the evaluation. The print coverage rate is defined as a percentage of an area of an image in black printed on the sheet P relative to a printable area of the sheet P.

Results of the durability test are shown in Table 1.

TABLE 1

| Sample No. | δl (mm) | Rz (μm) | Cycles | Result |
|---|---|---|---|---|
| 1 | 0.5 | 5.8 | 900 | Poor |
| 2 | 0.5 | 4.2 | 1600 | Poor |
| 3 | 0.3 | 5.2 | 2400 | Poor |
| 4 | 0.3 | 4.5 | 5600 | Poor |
| 5 | 0.1 | 5.3 | 13000 | Poor |
| 6 | 0.1 | 4.4 | 20400 | Poor |
| 7 | 0.07 | 5.6 | 23800 | Poor |
| 8 | 0.07 | 3.9 | 28900 | Poor |
| 9 | 0.05 | 5.1 | 32300 | Poor |
| 10 | 0.05 | 4.9 | 35100 | Good |
| 11 | 0.05 | 4.7 | 37400 | Good |
| 12 | 0.05 | 4.7 | 39700 | Good |
| 13 | 0.03 | 3.1 | 38000 | Good |
| 14 | 0.01 | 2.9 | 39700 | Good |

In Table 1, when the endless belt ran for 34,000 cycles or more without a problem, the result is designated as "good". When the endless belt broke before 34,000 cycles, the result is designated as "poor". As shown in Table 1, when the step portion δl and the ten-point mean roughness Rz decrease, the durability improves.

It is preferred to set the step portion δl to zero, but this is not practical. Therefore, in the embodiment, the step portion δl is preferably set equal to or less than 0.05 mm. It is found that when the endless belt 16 runs while the step portion is 0.05 mm or smaller, the endless belt 16 is not affected by the step portion δl.

When the step portion δl is too large, the flange 31 may contact with or be away from the edge surface 45, thereby causing repeated stress concentration and stress release. Further, when the endless belt 16 passes the driving roller 13 and the idle roller 14, the endless belt 16 may be buckled or broken through bending fatigue.

In the embodiment, the ten-point roughness Rz is preferably not higher than 5.0 μm. When the ten-point mean roughness Rz exceeds 5.0 μm, the endless belt 16 tends to be easily damaged. The edge surface 45 of the endless belt 16 always slides against the flange 31 and receives an external force. When the edge surface 45 is uneven, irregular stress concentration occurs, so that the endless belt 16 may break from the edge surface 45 due to a shear stress relative to the flange 31.

Accordingly, the step portion δl is set equal to or less than 0.05 mm, and the ten-point mean roughness Rz of the edge surface 45 of the endless belt 16 is set equal to or less than 5.0 μm. As a result, when the endless belt 16 runs, it is possible to prevent a crack from generating at the edge thereof, thereby improving the durability of the endless belt 16.

In the embodiment, the toner image on each photosensitive drum 65 is directly transferred onto the sheet P. Alternatively, the toner image may be transferred onto the sheet P after transferring the toner image to an endless belt as an intermediate transferring member.

Second Embodiment

A second embodiment of the invention will be described below. Components in the second embodiment similar to those in the first embodiment are designated by the same reference numerals, and explanations thereof are omitted. The components in the second embodiment similar to those in the first embodiment provide effects similar to those in the first embodiment.

Figure 7:
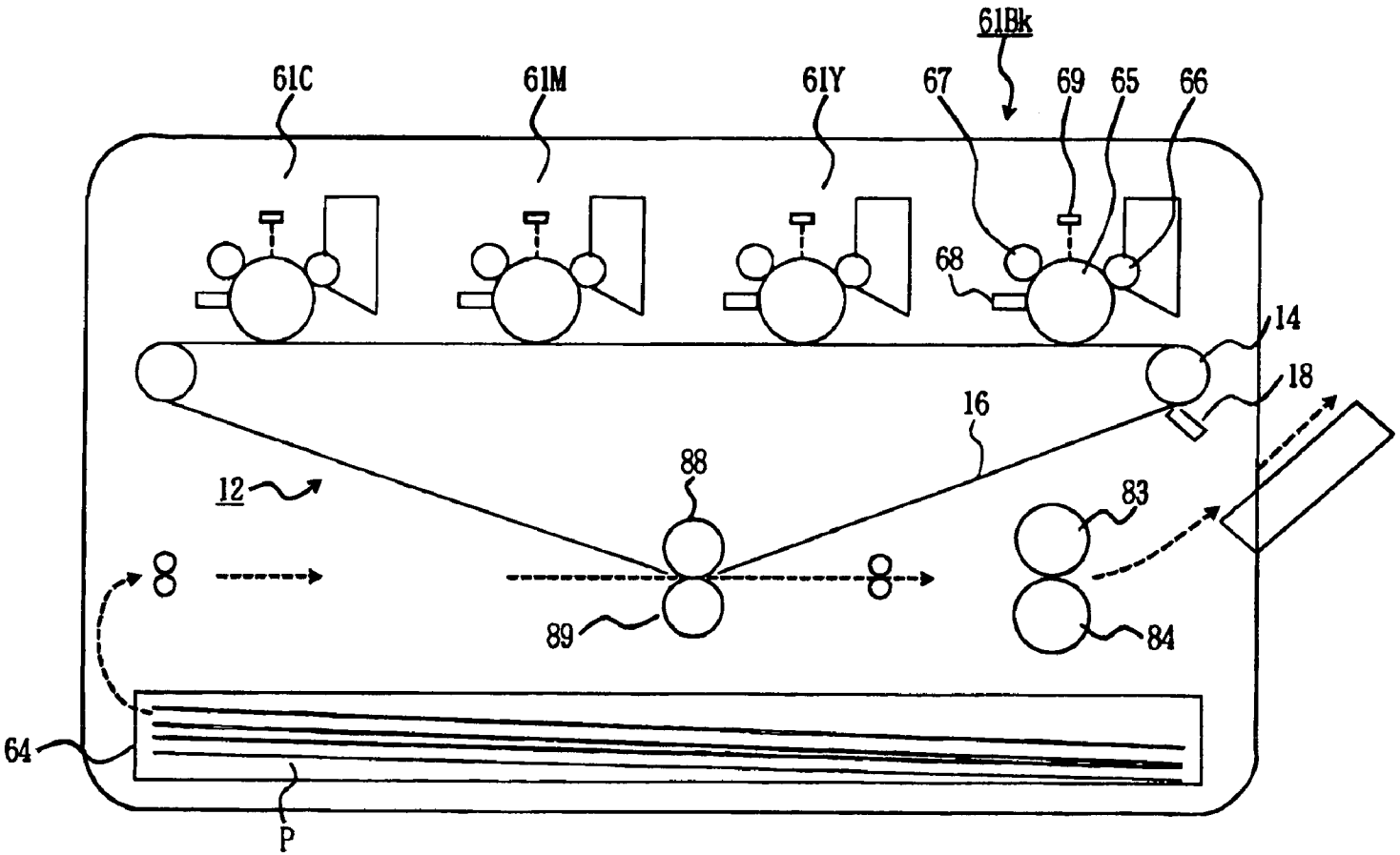
FIG. 7 is a schematic view showing a printer according to a second embodiment of the present invention.
Figure 8:
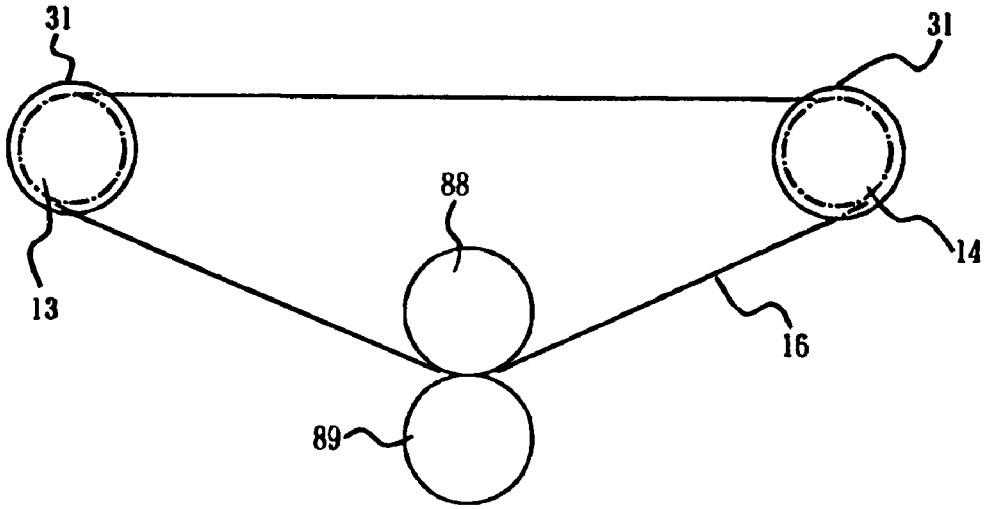
FIG. 8 is a schematic front view showing a belt device according to the second embodiment of the present invention.

FIG. 7 is a schematic view showing a printer according to the second embodiment of the present invention. FIG. 8 is a schematic front view showing a belt device according to the second embodiment of the present invention.

In the embodiment, the endless belt 16 is tensely placed around the driving roller 13 as a first roller; the idle roller 14 as a second roller; and a tension roller 88 as a third roller, so that the endless belt 16 runs in an arrow direction. The tension roller 88 and the transfer roller 89 are arranged with the endless belt 16 inbetween, and the sheet P as a record medium is fed between the endless belt 16 and the transfer roller 89. Then, toner images in colors are overlaid onto the endless belt 16, so that a color toner image is formed on the endless belt 16. Afterward, the color toner image is transferred onto the sheet P.

Third Embodiment

A third embodiment of the present invention will be described below. Components in the third embodiment similar to those in the first and second embodiments are designated by the same reference numerals, and explanations thereof are omitted. The components in the third embodiment similar to those in the first and second embodiments provide effects similar to those in the first and second embodiments.

Figure 9:
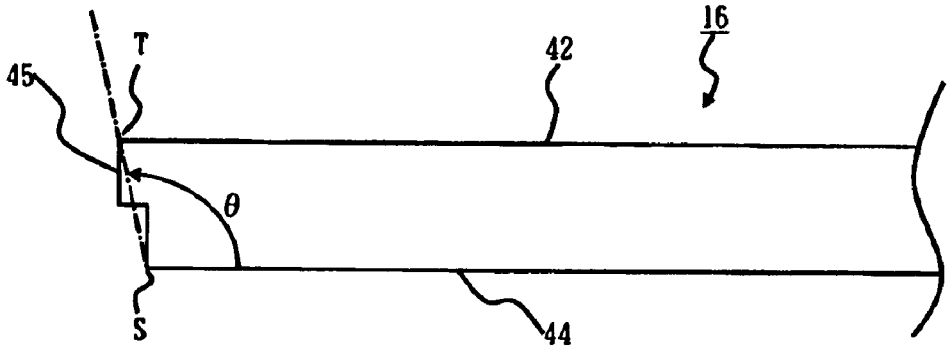
FIG. 9 is a schematic cross-sectional view No. 1 of an edge surface of an endless belt according to a third embodiment of the present invention.
Figure 10:
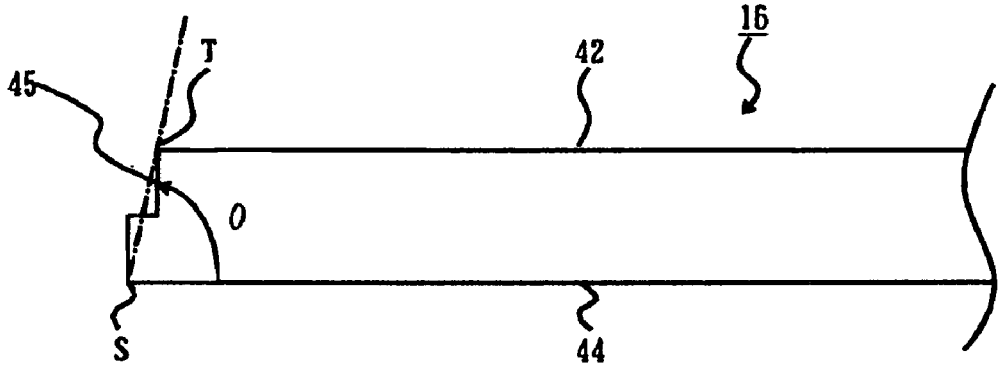
FIG. 10 is a schematic cross-sectional view No. 2 of the edge surface of the endless belt according to the third embodiment of the present invention.
Figure 11:
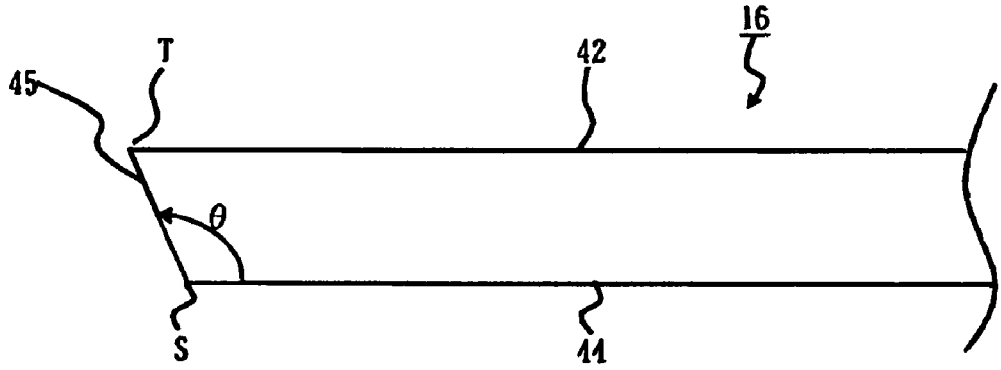
FIG. 11 is a cross-sectional view No. 3 of the edge surface of the endless belt according to the third embodiment of the present invention.
Figure 12:
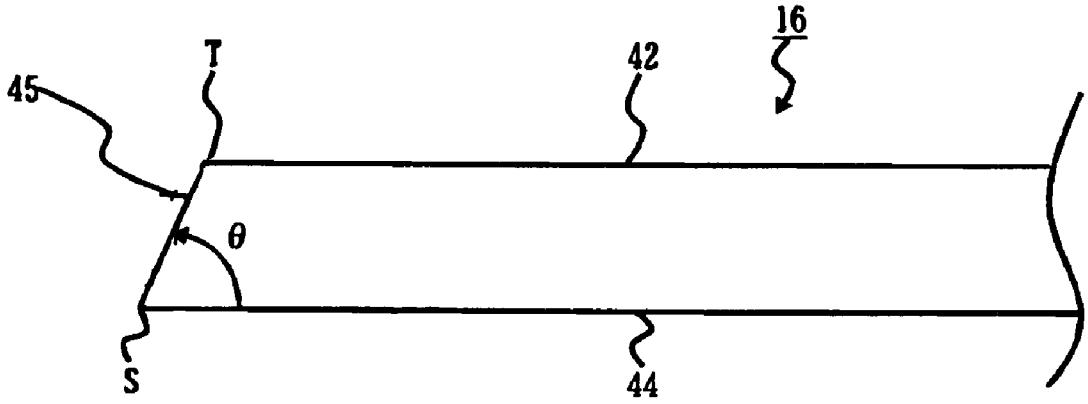
FIG. 12 is a cross-sectional view No 4 of the edge surface of the endless belt according to the third embodiment of the present invention.

FIG. 9 is a schematic cross-sectional view No. 1 of the edge surface 45 of the endless belt 16 according to a third embodiment of the present invention. FIG. 10 is a schematic cross-sectional view No. 2 of the edge surface 45 of the endless belt 16 according to the third embodiment of the present invention. FIG. 11 is a cross-sectional view No. 3 of the edge surface 45 of the endless belt 16 according to the third embodiment of the present invention. FIG. 12 is a cross-sectional view No 4 of the edge surface 45 of the endless belt 16 according to the third embodiment of the present invention.

In the first embodiment, the endless belt 16 is able to run for 34,000 cycles without a problem. Although the endless belt 16 has the step portion δl and the ten-point mean roughness Rz at a similar level, it is found that the endless belt 16 has a difference in the durability. In the third embodiment, a condition of the edge surface 45 of the endless belt 16 is investigated. The edge surface 45 of the endless belt 16 may have a different cross-section for the following reasons.

When the endless belt 34 is cut using an old cutter having a nicked edge, an uneven surface is easily formed on the edge surface 45 of the endless belt 16. This is because when the blade of the cutter 43 contacts with the endless belt member 34, a portion near the outer circumferential surface 42 is cut first and a crack generates as the blade proceeds. Also, when the cutter 43 is not tightly secured, the blade tends to proceed with various angles, thereby changing an edge surface angle, i.e., an angle of the edge surface 45 relative to the outer circumferential surface 42 and the inner circumferential surface 44 of the endless belt 16.

In FIGS. 9 to 12, an intersection point of the inner circumferential surface 44 and the edge surface 45 is denoted with T, and an intersection point of the outer circumferential surface 42 and the edge surface 45 is denoted with T. An end surface angle θ is defined as an angle between the inner circumferential surface 44 and a line ST between the intersection points S and T.

Results of the durability test are shown in Table 2.

TABLE 2

| Sample No. | δ1 (mm) | Rz (μm) | θ (°) | Cross-section shape | Cycles |
|---|---|---|---|---|---|
| 15 | 0.05 | 4.9 | 65 | | 35100 |
| 16 | 0.05 | 4.7 | 70 | | 40800 |
| 17 | 0.05 | 4.8 | 81 | | 41400 |
| 18 | 0.05 | 4.7 | 100 | | 42500 |
| 19 | 0.05 | 4.8 | 110 | | 40800 |
| 20 | 0.05 | 4.8 | 113 | | 35700 |
| 21 | 0.05 | 4.8 | 68 | inner projection | 34600 |
| 22 | 0.05 | 4.9 | 71 | inner projection | 40800 |
| 23 | 0.05 | 4.8 | 98 | outer projection | 41900 |
| 24 | 0.05 | 4.7 | 115 | outer projection | 34000 |

In Table 2, Samples Nos. 15 to 20 had the edge surface 45 having a flat surface as shown in FIGS. 11 and 12. Samples Nos. 21 and 20 had the edge surface 45 having a projecting portion on a side of the inner circumferential 44 as shown in FIG. 10, and Samples Nos. 23 and 24 had the edge surface 45 having a projecting portion on a side of the outer circumferential surface 42 as shown in FIG. 9.

In the embodiment, the endless belt 16 has the step portion δl equal to or less than 0.05 mm, and the edge surface 45 of the endless belt 16 has the ten-point mean roughness Rz equal to or less than 5.0 μm. Further, the edge surface angle θ is set equal to or larger than 70° and equal to or less than 110°.

It is noted that strength of a member relative to bending fatigue and external force significantly depends on a unit cross-sectional area, i.e., a thickness. Accordingly, when the endless belt 16 has a smaller thickness, the endless belt 16 tends to easily brake. Further, when the endless belt 16 contacts with the flange 31 in a smaller area, the edge surface 45 becomes more susceptible to damage. When the endless belt 16 unevenly contacts with the flange 31, stress concentration is localized, thereby making the edge surface 45 more susceptible to repetitive bending fatigue.

In the embodiment, the endless belt 16 has the step portion δl equal to or less than 0.05 mm, and the edge surface 45 of the endless belt 16 has the ten-point mean roughness Rz equal to or less than 5.0 μm. Further, the edge surface angle θ is set equal to or larger than 70° and equal to or less than 110°. Accordingly, it is possible to improve the durability of the endless belt.

In the embodiments of the invention, the printer is explained, and the invention can be applied to another types of image forming apparatus such as a copier, a fax machine, and a multifunction machine thereof. In addition, the endless belt 16 is described as the transfer belt of the printer, and the endless belt 16 can be used as a conveyer belt to convey a print medium, an intermediate transfer belt, a fixing belt, and so on.

The disclosure of Japanese Patent Application No. 2006-181733, filed on Jun. 30, 2006 is incorporated in the application by reference.

While the invention has been explained with reference to the specific embodiments of the invention, the explanation is illustrative and the invention is limited only by the appended claims.

What is claimed is:

1. An image forming apparatus comprising:

an image forming unit for forming an image;

a first roller;

a second roller;

a belt tensely placed between the first roller and the second roller, said belt having an outer circumferential surface facing the image forming unit and an edge surface substantially perpendicular to the outer circumferential surface, said edge surface having a step portion of equal to or smaller than 0.05 mm and a ten-point mean roughness (Rz) of equal to or smaller than 5.0 μm; and a guiding member disposed at an end portion of at least one of the first roller and the second roller for guiding the edge surface of the belt, said guiding member being formed in a flange shape having a diameter greater than that of the at least one of the first roller and the second roller so that the guide member abuts against the edge surface from outside.

2. The image forming apparatus according to claim 1, wherein said belt includes an inner circumferential surface extending relative to the edge surface by an angle equal to or larger than 70° and equal to or smaller than 110°.

3. The image forming apparatus according to claim 1, wherein said belt is formed of a material having Young's modulus of equal to or larger than 2000 MPa.

4. The image forming apparatus according to claim 1, wherein said belt includes the edge surface having a projecting portion on a side of an inner circumferential surface of the belt.

5. The image forming apparatus according to claim 1, wherein said belt includes the edge surface having a projecting portion on a side of the outer circumferential surface of the belt.

6. The image forming apparatus according to claim 1, further comprising a third roller for applying tension to the belt.

7. The image forming apparatus according to claim 1, wherein said belt is arranged to transport a recording medium so that the image forming unit forms the image on the recording medium.

8. The image forming apparatus according to claim 1, wherein said image forming unit is arranged to form the image on the belt.

9. The image forming apparatus according to claim 1, wherein said edge surface has the step portion of equal to or smaller than 0.05 mm in a height perpendicular to the edge surface.

* * * * *